US009220939B2

(12) United States Patent
Chen

(10) Patent No.: US 9,220,939 B2
(45) Date of Patent: Dec. 29, 2015

(54) REHABILITATION OR EXERCISING CHAIR DEVICE

(71) Applicant: Paul Chen, Vancouver (CA)

(72) Inventor: Paul Chen, Vancouver (CA)

( * ) Notice: Subject to any disclaimer, the term of this patent is extended or adjusted under 35 U.S.C. 154(b) by 134 days.

(21) Appl. No.: 14/224,215

(22) Filed: Mar. 25, 2014

(65) Prior Publication Data

US 2015/0273269 A1 Oct. 1, 2015

(51) Int. Cl.

| | |
|---|---|
| ***A63B 26/00*** | (2006.01) |
| ***A63B 21/04*** | (2006.01) |
| ***A63B 21/008*** | (2006.01) |
| ***A63B 21/00*** | (2006.01) |
| ***A63B 21/02*** | (2006.01) |
| ***A63B 21/055*** | (2006.01) |
| ***A63B 23/12*** | (2006.01) |
| ***A47C 9/00*** | (2006.01) |

(52) U.S. Cl.

CPC ..... *A63B 21/1461* (2013.01); *A47C 9/002* (2013.01); *A63B 21/023* (2013.01); *A63B 21/0421* (2013.01); *A63B 21/0428* (2013.01); *A63B 21/055* (2013.01); *A63B 23/1254* (2013.01)

(58) Field of Classification Search

CPC ..... A63B 21/0081; A63B 21/0083; A63B 21/0085; A63B 21/0087; A63B 21/023; A63B 21/026; A63B 21/04; A63B 21/0407; A63B 21/0421; A63B 21/0428; A63B 21/0435; A63B 21/055; A63B 21/1461; A63B 21/1492; A63B 21/1496; A63B 23/1245; A63B 23/1254; A63B 23/1263; A63B 23/1272; A47C 9/002; A47C 9/005

See application file for complete search history.

(56) References Cited

U.S. PATENT DOCUMENTS

| | | | | |
|---|---|---|---|---|
| 4,799,670 | A * | 1/1989 | Williamson | 482/97 |
| 4,817,943 | A * | 4/1989 | Pipasik | 482/97 |
| 5,080,353 | A | 1/1992 | Tench | |
| 5,221,245 | A | 6/1993 | Yeh | |
| 5,486,150 | A * | 1/1996 | Randolph | 482/133 |
| 6,387,023 | B1 * | 5/2002 | Liga, Jr. | 482/130 |
| 6,565,494 | B1 * | 5/2003 | Chen | 482/124 |
| 7,276,018 | B2 | 10/2007 | Studdard | |
| 8,109,864 | B2 | 2/2012 | Tseng | |

* cited by examiner

*Primary Examiner* — Oren Ginsberg
(74) *Attorney, Agent, or Firm* — Charles E. Baxley

(57) ABSTRACT

An exercising device includes a chair member having a seat element disposed on a base supporting member, two handles each include a lower portion rotatably attached to the base supporting member and each include a spring biasing member provided on the handle, a resistive device engaged with the handles for applying a spring biasing force to resist the rotational movement of the handles relative to the chair member, and two arm rests each include a bottom portion attached to the spring biasing member for supporting a forearm of a user and for allowing the arm rest to be pivoted laterally and upwardly and downwardly relative to the handle and the chair member with the spring biasing member.

9 Claims, 4 Drawing Sheets

REHABILITATION OR EXERCISING CHAIR DEVICE

BACKGROUND OF THE INVENTION

1. Field of the Invention

The present invention relates to a rehabilitation or exercising chair device, and more particularly to a rehabilitation or exercising chair device including a structure or configuration for the disable persons to comfortably rehabilitate or exercise their hands and/or chest portion and/or their upper muscle groups and including a simplified structure or configuration that may be made or manufactured with a greatly decreased or reduced manufacturing cost.

2. Description of the Prior Art

Various kinds of typical rehabilitation or exercising devices have been developed and provided for the disable persons to conduct or operate various kinds of exercises, and comprise a large number of the exercising devices for training or exercising the upper muscle groups and/or the lower or other muscle groups of the users.

For example, U.S. Pat. No. 5,080,353 to Tench, U.S. Pat. No. 5,221,245 to Yeh, U.S. Pat. No. 7,276,018 to Studdard, and U.S. Pat. No. 8,109,864 to Tseng disclose several of the typical rehabilitation or exercising devices each comprising an exercising equipment or arrangement or the like disposed or attached or mounted or secured or formed or provided on the base supporting member for being actuated or operated by the user to train or exercise the upper muscle groups and/or the lower or other muscle groups of the users.

However, the typical rehabilitation or exercising devices comprise a complicated structure or configuration that may not be made or manufactured and may not be used for the disable persons to comfortably rehabilitate or exercise their hands and/or chest portion and/or their upper muscle groups.

The present invention has arisen to mitigate and/or obviate the afore-described disadvantages of the conventional rehabilitation or exercising devices.

SUMMARY OF THE INVENTION

The primary objective of the present invention is to provide a rehabilitation or exercising chair device including a structure or configuration for the disable persons to comfortably rehabilitate or exercise their hands and/or chest portion and/or their upper muscle groups and including a simplified structure or configuration that may be made or manufactured with a greatly decreased manufacturing cost.

In accordance with one aspect of the invention, there is provided an exercising device comprising a chair member including a seat element provided on a base supporting member for supporting a user on the seat element, two handles each including a lower portion rotatably attached to the base supporting member with a pivot axle for allowing the handle to be pivoted or rotated relative to the chair member, and each including a spring biasing column or rod or cylindrical member provided on top of the handle, a resistive device engaged with the handles for applying a spring biasing force or resistive force to the handles and for resisting a rotational movement of the handles relative to the chair member, and two arm rests each including a bottom portion attached to the spring biasing member for supporting a forearm of a user and for allowing the arm rest to be pivoted or moved laterally and upwardly and downwardly relative to the handle and the chair member against the spring biasing member by the user, and for allowing the handles to be pivoted or moved relative to the chair member.

The chair member includes a limiting device, such as a lateral beam or rod attached to the chair member and having two pads or cushions or stops for engaging with the handles and for limiting the handles to rotate relative to the chair member. The limiting device includes a beam attached to the chair member and disposed behind the handles for engaging with the handles and for limiting the handles to rotate relative to the chair member.

The handles each include a compartment formed therein, and a post slidably and adjustably received and engaged in the compartment of the handle and movable up and down and into and out of the compartment of the handle to different positions or locations or extensions, and the arm rests are attached to upper portions of the posts respectively for supporting the forearm of the user.

The post includes a number of orifices formed therein for adjustably securing the post to the handle at a selected position. For example, the handles each include a latch or lock or fastener for selectively engaging with either of the orifices of the post and for adjustably securing or latching the post to the handle at the selected position.

The arm rests each include a cylindrical or tubular member attached to the lower or bottom portion of the arm rest, and a sliding extension is slidably and adjustably engaged into the tubular member and movable into and out of the tubular member to different positions or locations or extensions, and the extension includes a knob or hand grip provided thereon for being grasped and held by the user.

The arm rests each include a spring biasing element engaged in the tubular member and engaged with the extension for biasing and moving or forcing the extension to move into the tubular member. The spring biasing member may be selected from a cylindrical rod or the like.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
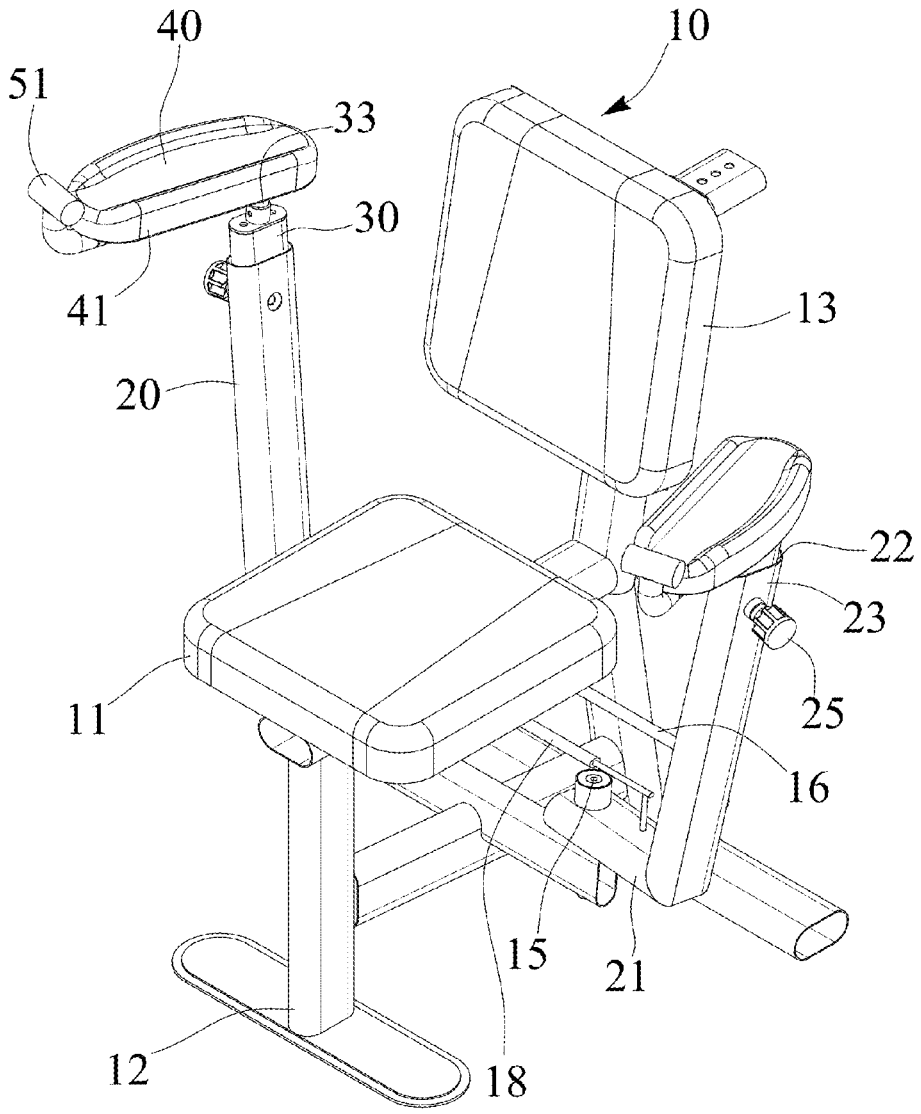
FIG. 1 is a perspective view of a rehabilitation or exercising chair device in accordance with the present invention.
Figure 2:
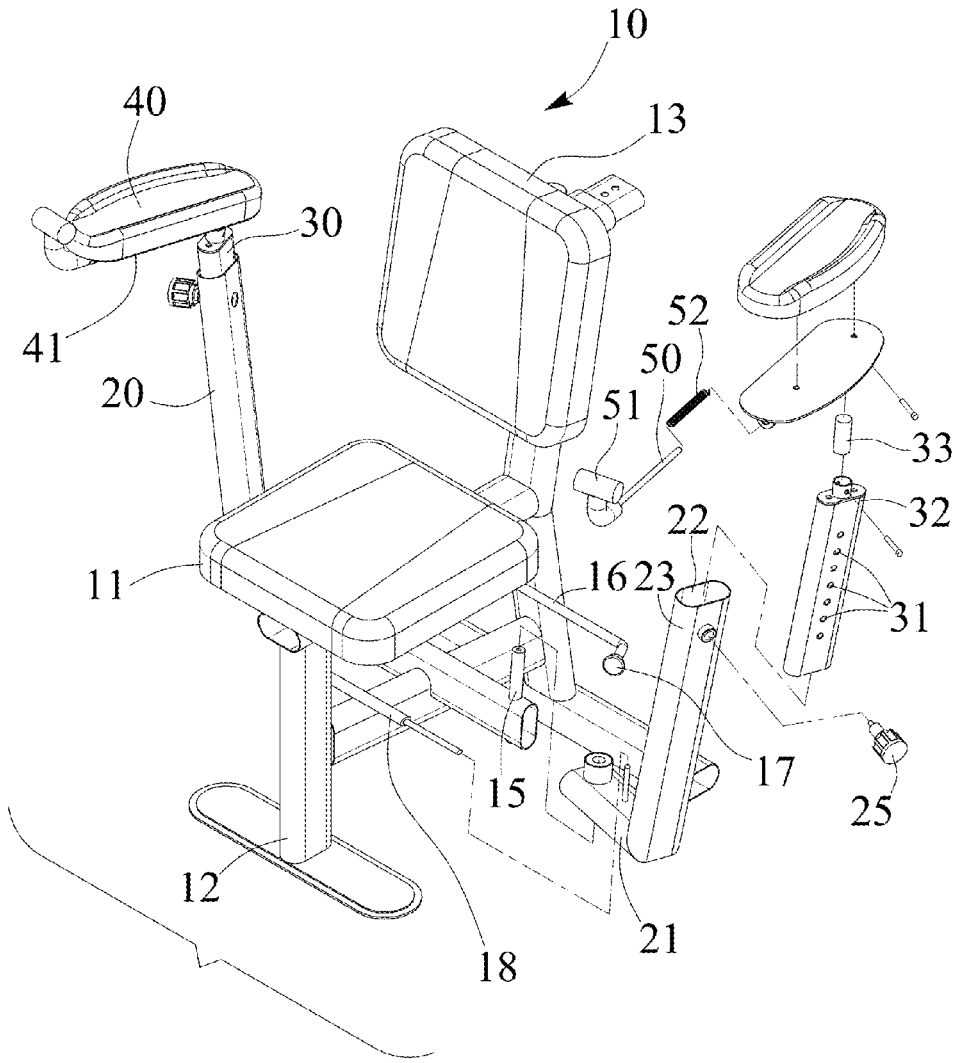
FIG. 2 is a partial exploded view of the rehabilitation or exercising chair device.
Figure 3:
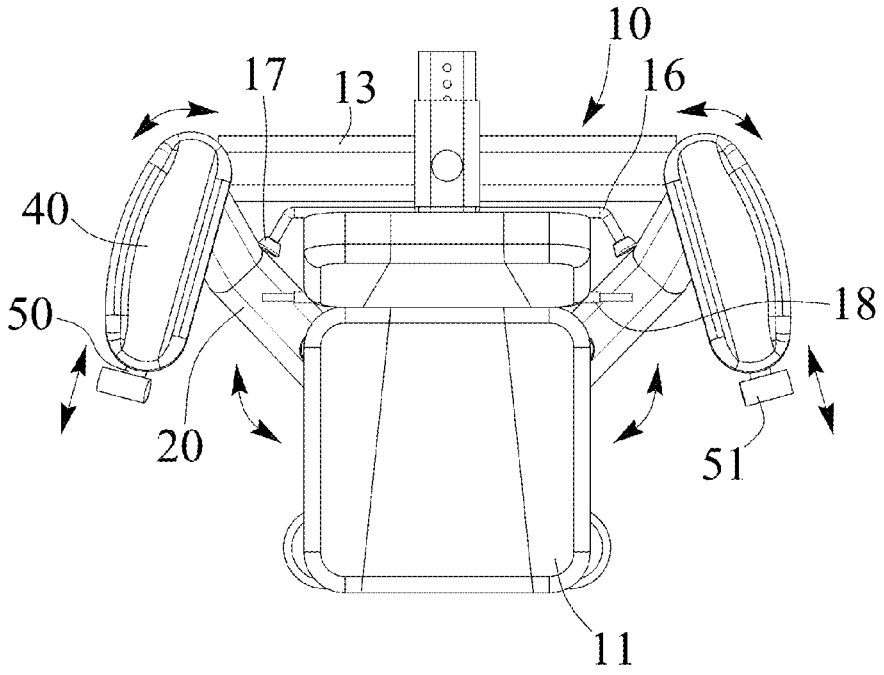
FIG. 3 is an upper plan schematic view of the rehabilitation or exercising chair device.

Referring to the drawings, and initially to FIGS. 1-3, a rehabilitation or exercising chair device in accordance with the present invention is particularly provided for the disable persons to comfortably rehabilitate or exercise their hands and/or chest portions and/or their upper muscle groups, and comprises a chair member 10 including a seat cushion or seat pad or seat element 11 formed or provided or disposed on a supporting stand or base supporting member 12 for supporting the user thereon, and a seat back 13 disposed or attached or mounted or secured on the chair member 10 for supporting the back portion of the user or the like. The above-described structure or configuration for the seat element 11 and the base supporting member 12 and the seat back 13 is typical and is not related to the present invention and will not be described in further details.

Figure 4:
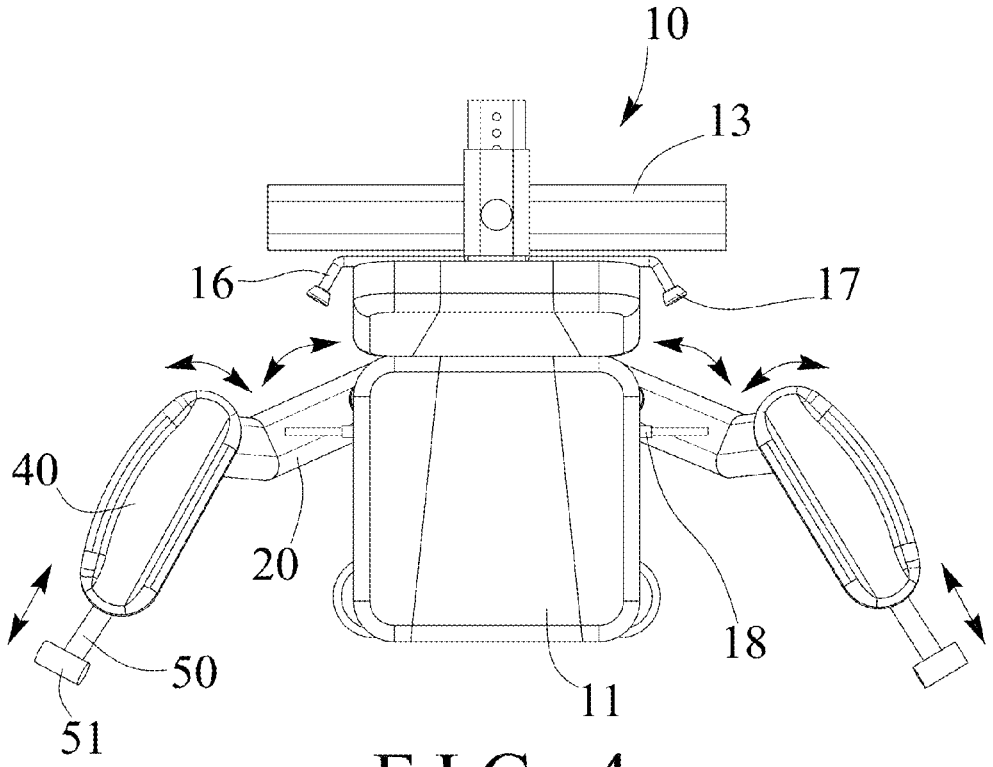
FIG. 4 is another upper plan schematic view similar to FIG. 3, illustrating the operation of the rehabilitation or exercising chair device.

Two levers or bars or frames or posts or handles 20 each include a substantially L-shaped structure or configuration, and each include a lower portion 21 pivotally or rotatably attached or mounted or secured to the base supporting member 12 of the chair member 10 with a pivot axle 15 for allowing the handles 20 to be pivoted or rotated forwardly and rearwardly relative to the chair member 10 (FIGS. 3, 4), and each include a bore or chamber or compartment 22 formed therein, such as formed in the upper portion 23 thereof for slidably or adjustably receiving or engaging with a follower or sliding member or post 30 and for allowing the post 30 to be moved up and down or into or out of the compartment 22 of the handle 20 (FIGS. 5, 6), and to be slid or moved or adjusted relative to the respective handle 20 to different positions or locations or extensions.

The chair member 10 may further include a stop or limiting device 16, such as a lever or beam 16 attached or mounted or secured to the required or suitable or selected position or location of the chair member 10 and disposed or located behind the handles 20, and include two pads or cushions or stops 17 disposed or located behind the handles 20 for selectively engaging with the handles 20 and for limiting the handles 20 to pivot or rotate relative to the chair member 10, and a spring biasing member or pneumatic or hydraulic resistive device 18 may further be provided and attached or mounted or secured or engaged with or between the handles 20, or between the handles 20 and the base supporting member 12 of the chair member 10 for applying a spring biasing force against or between the handles 20, or between the handles 20 and the base supporting member 12 of the chair member 10 and for resisting the rotational movement between the handles 20 and the chair member 10 or the like.

A latch or catch or lock or fastener 25 is attached or mounted or secured to the respective handle 20, such as the upper portion 23 of the respective handle 20, and the post 30 includes a number of holes or apertures or orifices 31 formed therein and preferably equally spaced from each other for selectively engaging with the fastener 25 which may adjustably secure or anchor or retain or position the post 30 to the respective handle 20 at the required or suitable or selected position or location or extension, for suitably fitting the users of different sizes or dimensions or heights. The posts 30 each include an upper portion 32 extendible out of the respective handle 20, and each include a spring biasing post or column or cylindrical rod or member 33 attached or mounted or secured on top of the post 30 or on the upper portion 32 of the post 30 of the handle 20.

A pair of hand grips or arm rests 40 each include a lower or bottom portion 41 attached or mounted or secured to the upper portion 32 of the post 30, particularly the spring biasing member 33, for supporting the forearms of the user and/or for being grasped or gripped or held by the user, and for allowing the arm rests 40 to be pivoted or rotated or swung laterally or horizontally (FIGS. 3, 4) or upwardly or downwardly (FIGS. 5, 6) relative to the handles 20 and/or the chair member 10 by the user with the spring biasing member 33, and for allowing the user to rehabilitate or train or exercise the upper muscle groups and/or the forearms of the user. The arm rests 40 each further include a rail or track or casing or tubular member 42 formed or provided or attached or mounted or secured to the lower or bottom portion 41 of the respective arm rest 40 (FIGS. 5, 6).

A sliding member or extension 50 is further provided (FIGS. 2, 6) and slidably or adjustably fitted and engaged into or with the tubular member 42 of the respective arm rest 40 for allowing the extension 50 to be moved forwardly and rearwardly or into or out of the tubular member 42 of the respective arm rest 40, and the extension 50 includes a knob or hand grip 51 formed or provided on the front portion or free end portion thereof for being grasped or gripped or held by the user, and for allowing the extension 50 to be selectively moved into or out of the tubular member 42 of the respective arm rest 40 by the user. As shown in FIG. 2, a spring biasing member or coil or element 52 is disposed or engaged into the tubular member 42 of the respective arm rest 40 and engaged with the extension 50 (FIG. 6) for biasing and forcing or moving the extension 50 into the tubular member 42 of the respective arm rest 40.

Figure 5:
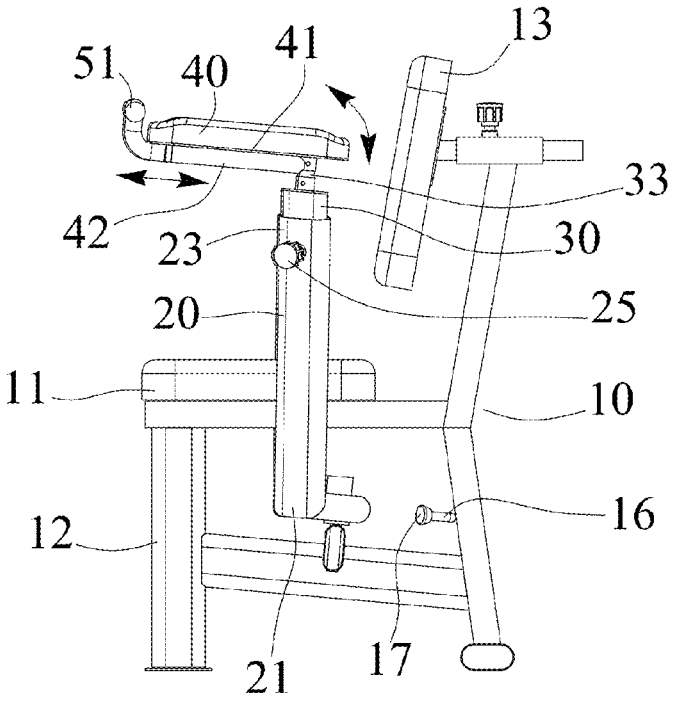
FIG. 5 is a side plan schematic view of the rehabilitation or exercising chair device.
Figure 6:
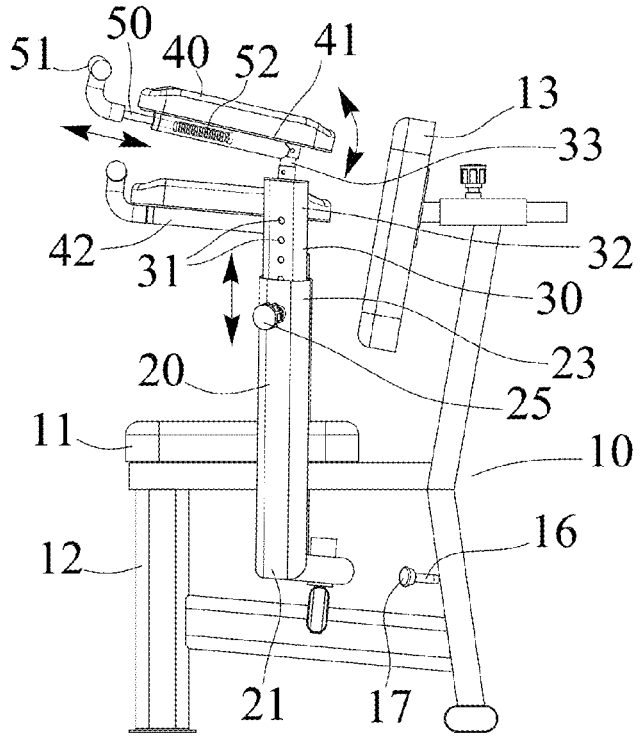
FIG. 6 is another side plan schematic view similar to FIG. 5, illustrating the operation of the rehabilitation or exercising chair device.

In operation, as shown in FIGS. 5 and 6, the post 30 may be moved up and down or into or out of the compartment 22 of the handle 20 and may be slid or moved or adjusted relative to the respective handle 20 to different positions or locations or extensions, and may be adjustably secured or anchored or retained or positioned to the respective handle 20 at the required or suitable or selected position or location or extension with the fastener 25, for suitably fitting the users of different sizes or dimensions or heights, and for allowing the forearms of the user to be suitably and comfortably rested or supported on the arm rests 40, and for allowing the user to suitably grasp or grip or hold the hand grips 51, and for allowing the user to suitably conduct or operate various kinds of exercises or operations.

As also shown in FIGS. 5 and 6, the user may grasp or grip or hold the hand grips 51 and may move and force the extension 50 to selectively move out of the tubular member 42 of the respective arm rest 40 against the spring biasing force of the spring biasing element 52, and the spring biasing element 52 may selectively bias and force or move the extension 50 into the tubular member 42 of the respective arm rest 40. In addition, the user may pivot or rotate or swing the arm rests 40 laterally or horizontally (FIGS. 3, 4) or upwardly or downwardly (FIGS. 5, 6) relative to the handles 20 and/or the chair member 10 against the spring biasing member 33, and/or may pivot or rotate or swing the handles 20 relative to the chair member 10 for allowing the user to further rehabilitate or train or operate or exercise the upper muscle groups and/or the forearms of the user, and/or to train or exercise the upper muscle groups and/or the chest portion and/or the hands of the users. The rehabilitation or exercising chair device includes a simplified structure that may be made or manufactured with a greatly decreased manufacturing cost.

Accordingly, the rehabilitation or exercising chair device in accordance with the present invention includes a structure or configuration for the disable persons to comfortably rehabilitate or exercise their hands and/or chest portion and/or their upper muscle groups and including a simplified structure or configuration that may be made or manufactured with a greatly decreased manufacturing cost.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exercising device comprising:

a chair member including a seat element provided on a base supporting member, two handles each including a lower portion rotatably attached to said base supporting member with a vertical pivot axle for allowing said handle to be rotated relative to said chair member, and each including a spring biasing member provided on top of said handle, a resistive device engaged with said handles for applying a spring biasing force to said handles and for resisting a rotational movement about said pivot axle of said handles relative to said chair member, and two arm rests each including a bottom portion directly attached to said spring biasing member for supporting a forearm of a user and for allowing said arm rest to be pivoted laterally and upwardly and downwardly relative to said handle and said chair member with said spring biasing member.

2. The exercising device as claimed in claim 1, wherein said chair member includes a limiting device attached to said chair member for engaging with said handles and for limiting said handles to rotate relative to said chair member.

3. The exercising device as claimed in claim 2, wherein said limiting device includes a beam attached to said chair member and disposed behind said handles for engaging with said handles.

4. The exercising device as claimed in claim 1, wherein said handles each include a compartment formed therein, and a post slidably and adjustably received and engaged in said compartment of said handle and movable up and down and into and out of said compartment of said handle, and said arm rests are attached to upper portions of said posts respectively.

5. The exercising device as claimed in claim 4, wherein said post includes a plurality of orifices formed therein for adjustably securing said post to said handle at a selected position.

6. The exercising device as claimed in claim 5, wherein said handles each include a fastener for selectively engaging with any of said orifices of said post and for adjustably securing said post to said handle at said selected position.

7. The exercising device as claimed in claim 1, wherein said arm rests each include a tubular member attached to said bottom portion of said arm rest, and a sliding extension slidably and adjustably engaged into said tubular member and movable into and out of said tubular member, and said extension includes a hand grip provided thereon for being grasped and held by the user.

8. The exercising device as claimed in claim 7, wherein said arm rests each include a spring biasing element engaged in said tubular member and engaged with said extension for biasing and forcing said extension to move into said tubular member.

9. The exercising device as claimed in claim 1, wherein said spring biasing member is selected from a cylindrical rod.

* * * * *